US012520888B2

(12) United States Patent
Morales Alvarez

(10) Patent No.: US 12,520,888 B2
(45) Date of Patent: Jan. 13, 2026

(54) LOADING BASE FOR FACIAL PROTECTION DEVICES

(71) Applicant: Jose Carlos Morales Alvarez, Cartagena (ES)

(72) Inventor: Jose Carlos Morales Alvarez, Cartagena (ES)

( * ) Notice: Subject to any disclaimer, the term of this patent is extended or adjusted under 35 U.S.C. 154(b) by 77 days.

(21) Appl. No.: 18/294,965

(22) PCT Filed: Aug. 3, 2022

(86) PCT No.: PCT/ES2022/000030
§ 371 (c)(1),
(2) Date: Feb. 2, 2024

(87) PCT Pub. No.: WO2023/012387
PCT Pub. Date: Feb. 9, 2023

(65) Prior Publication Data

US 2025/0082049 A1 Mar. 13, 2025

(30) Foreign Application Priority Data

Aug. 4, 2021 (ES) ..... 202131613U

(51) Int. Cl.
*A41D 13/11* (2006.01)

(52) U.S. Cl.
CPC ..... *A41D 13/11* (2013.01)

(58) Field of Classification Search
CPC ... A61L 2/10; A61L 2202/24; A41D 13/1184; A41D 2300/33; A41D 13/1161; A41D 27/12; A41D 13/11; A62B 18/08; A42B 3/30; A42B 3/18; A42B 3/185; A42B 3/20; A42B 3/205; A42B 3/22; A61B 90/04
See application file for complete search history.

(56) References Cited

U.S. PATENT DOCUMENTS

2021/0016332 A1 1/2021 Scherer et al.

FOREIGN PATENT DOCUMENTS

| | | | | |
|---|---|---|---|---|
| CN | 103025444 A | | 4/2013 | |
| CN | 203954237 U | | 11/2014 | |
| ES | 1253694 U | * | 10/2020 | ..... A41D 13/11 |
| JP | 3211531 U | | 7/2017 | |
| KR | 20210136887 A | | 11/2021 | |

OTHER PUBLICATIONS

Dec. 1, 2022—International Search Report—Intl App PCT/ES2022/000030.

* cited by examiner

*Primary Examiner* — Ophelia A Hawthorne
(74) *Attorney, Agent, or Firm* — Banner & Witcoff, Ltd.

(57) ABSTRACT

A loading base for facial protection devices includes a main housing and support arms on which the facial protection device with a screen rests, and wherein the loading base incorporates a bridge that can move vertically on the support arms. The bridge has a structure in which two arches are defined forming an arched slot inside of which a plurality of UV LEDs are arranged to disinfect both surfaces of the screen of the facial protection device. The bridge is connected to the support arms by perforations that are linked to a pair of vertical augers provided in slots made in the support arms, and the vertical augers are coupled by a transmission to an electric motor.

7 Claims, 5 Drawing Sheets

LOADING BASE FOR FACIAL PROTECTION DEVICES

CROSS REFERENCE TO RELATED APPLICATIONS

This is a U.S. National Phase Application under 35 U.S.C. § 371 of International Application No. PCT/ES2022/000030, filed Aug. 3, 2022, which claims priority to Spanish Application No. U202131613, filed Aug. 4, 2021, which was published Under PCT Article 21(2), the entire contents of which are incorporated herein by reference.

FIELD OF THE ART

The present invention relates to a loading base for facial protection devices of the type used in healthcare settings by medical personnel, nurses, assistants, dentists, etc., and materialized as facial protection equipment which is equipped with various elements that facilitate healthcare practice, such as a LED lamp, a camera, a microphone, and swinging elements to facilitate moving the visor with respect to the support forming the device.

The object of the invention is to provide a base which, in addition to allowing a base for supporting or holding the work screen, allows recharging different electronic equipment associated with the facial protection device, and allows disinfecting both the outer face and the inner face of the transparent glass or plastic protective screen or visor of said device.

BACKGROUND OF THE INVENTION

Facial protection devices used in healthcare settings by medical personnel, nurses, assistants, dentists, and the like, and materialized as facial protection equipment which is equipped with various electronic elements that facilitate healthcare practice, such as a LED lamp, a camera, a microphone, and swinging elements to facilitate moving the visor with respect to the support forming the device, are known.

A device of this type is described in utility model U202031414, such that said device further includes in its housing a series of UV LEDs which project lights beans towards the outer surface of the screen.

This solution is not satisfactory because the UV light is projected exclusively on the outer face of the screen, to which it should be further mentioned that the dimensions of said screen are often greater than the effective reach of the UV LEDs.

At the same time, it is known that this type of lighting poses a risk to the user's eyes, so it is preferable for the disinfection means of the device to be independent of said device in order to ensure that said disinfection operations cannot be performed with the device applied on the user's head.

DESCRIPTION OF THE INVENTION

The proposed loading base for facial protection devices solves in a fully satisfactory manner the problems set forth above by ensuring perfect disinfection of the facial protection device in a completely safe manner.

To that end, the loading base for facial protection devices is made up of a main housing having support arms on which a facial protection device with a screen rests.

Based on this conventional structuring, the base has been envisaged to incorporate a bridge that can move vertically on the support arms which, in an inoperative situation, is flush with the main housing of the base, wherein the bridge has a structure in which two parallel arches are defined determining an arched slot, according to the curvature and horizontal section of the screen of the facial protection device, said bridge incorporating inside its arches a plurality of UV LEDs for disinfecting both surfaces of the screen of the facial protection device.

To that end, the mentioned bridge can preferably move vertically from a pair of vertical augers associated with the support arms determining the support on which the facial protection device rests, these augers rotate in a synchronized manner by being linked to the ends of the bridge through the corresponding threading, being actuated through a transmission linked to an electric motor.

Specifically, the ends of the bridge incorporate perforations through which the bridge is linked to the vertical augers, the rotation of the vertical augers being actuated by means of a transmission linked to an electric motor.

In this way, the bridge can move vertically and in a controlled manner along the entire surface of the visor of the facial protection device, applying UV light at a minimum distance from said screen, which ensures perfect disinfection of the visor on both faces, such that once the disinfection process ends, the arch will return to its retracted position being flush with the main housing of the base.

As an additional safety measure, the base has been envisaged to include proximity sensors which detect the presence of any people in the vicinities of the base and through which said disinfection process is stopped momentarily until the area is clear.

BRIEF DESCRIPTION OF THE DRAWINGS

To complement the description that will be made below and in order to help to better understand the features of the invention according to a preferred practical embodiment thereof, a set of drawings is attached as an integral part of said description in which the following is depicted in a non-limiting illustrative manner.

Lastly.

PREFERRED EMBODIMENT OF THE INVENTION

Figure 1:
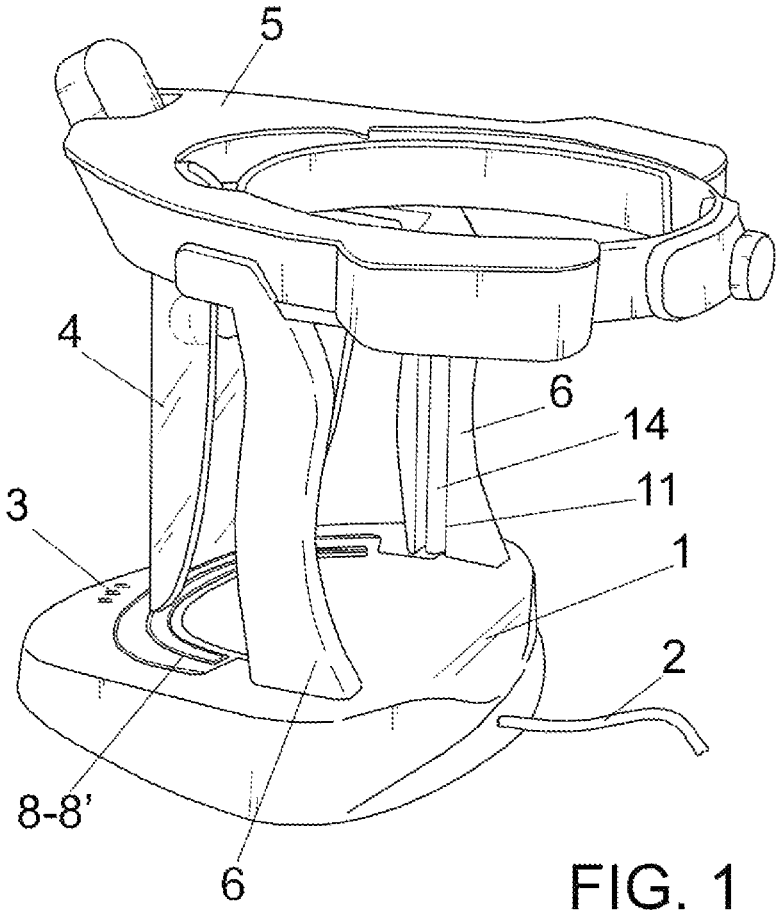
FIG. 1 shows a rear perspective view of a loading base for facial protection devices made according to the object of the present invention, with the corresponding facial protection device arranged thereon.
Figure 2:
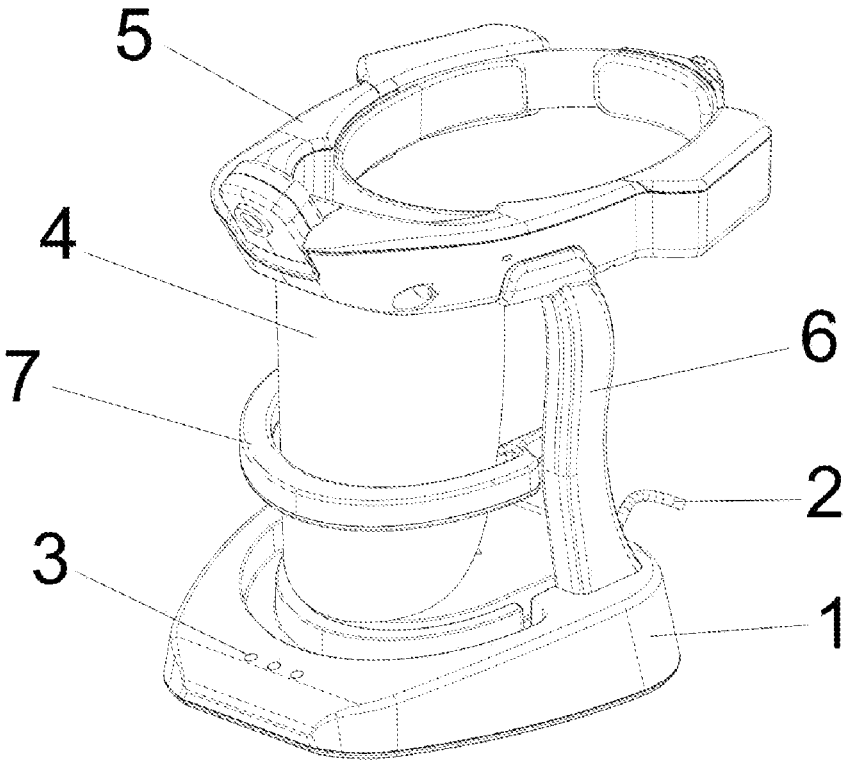
FIG. 2 shows a front perspective view of a loading base for facial protection devices made according to the object of the present invention, with the corresponding facial protection device arranged thereon.
Figure 3:
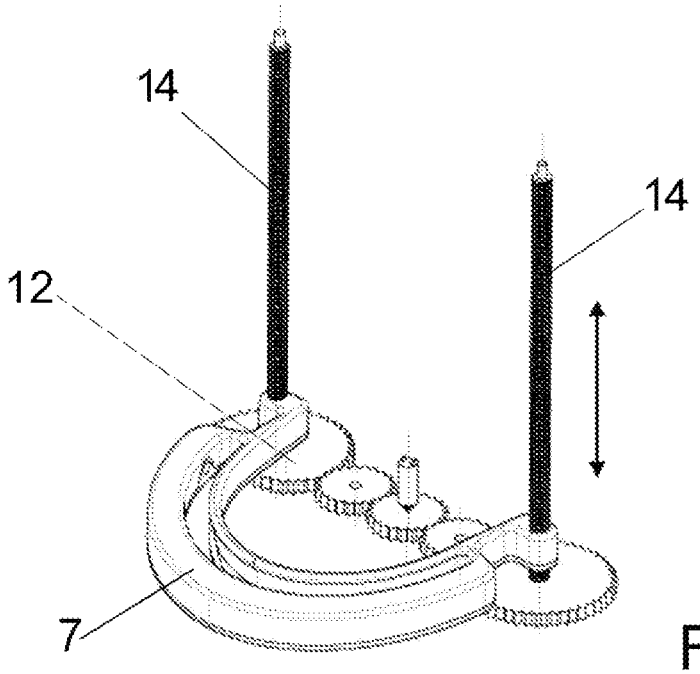
FIG. 3 shows the perspective view of a detail of the mechanism for lifting the disinfection bridge, with said bridge being in an inoperative situation in the figure.
Figure 4:
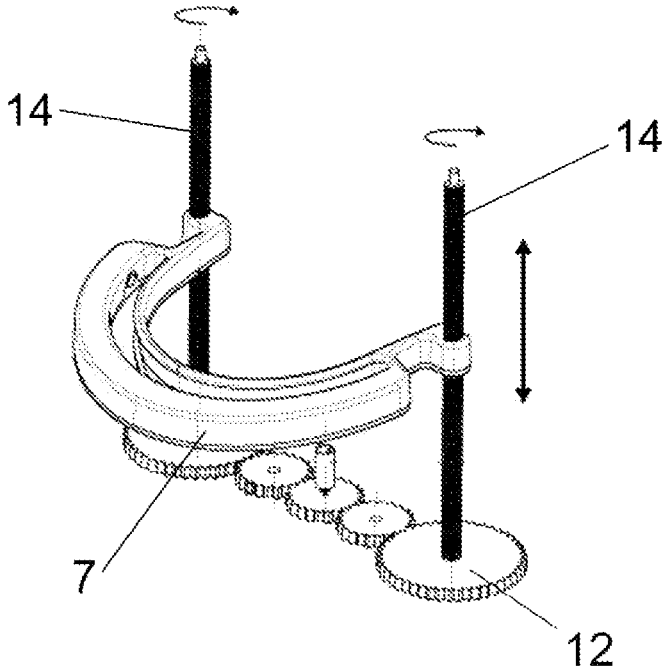
FIG. 4 shows a view similar to that of FIG. 2, but in which the bridge is in an intermediate working situation.

In view of the mentioned figures, it can be seen how the loading base for facial protection devices is made up of a main housing (1) inside which there are established the electronics for providing electric supply through a network connection cable (2) for recharging the battery of a facial protection device having a visor provided with a screen (4) associated with a housing (5), having in the front area thereof a LED lamp and a camera, including a microphone, and swinging elements to facilitate moving the visor with respect to the support forming the device, as well as an internal battery for powering the electronic equipment, said battery having an electrical connector established on the lower area of the housing (5) at the level of the support arms (6) which project from the loading base, one of which will include a complementary electrical connector for powering said battery.

The invention focuses on the fact that the base incorporates a retractable bridge (7) that can move vertically which, in an inoperative situation, is flush with the main housing (1) of the base, said bridge (7) having a structure in which two parallel arches (8-8') are defined determining an arched slot (9), according to the curvature and horizontal section of the transparent visor or screen (4) of the facial protection device, with said slot being arranged facing the screen and below same.

Figure 5:
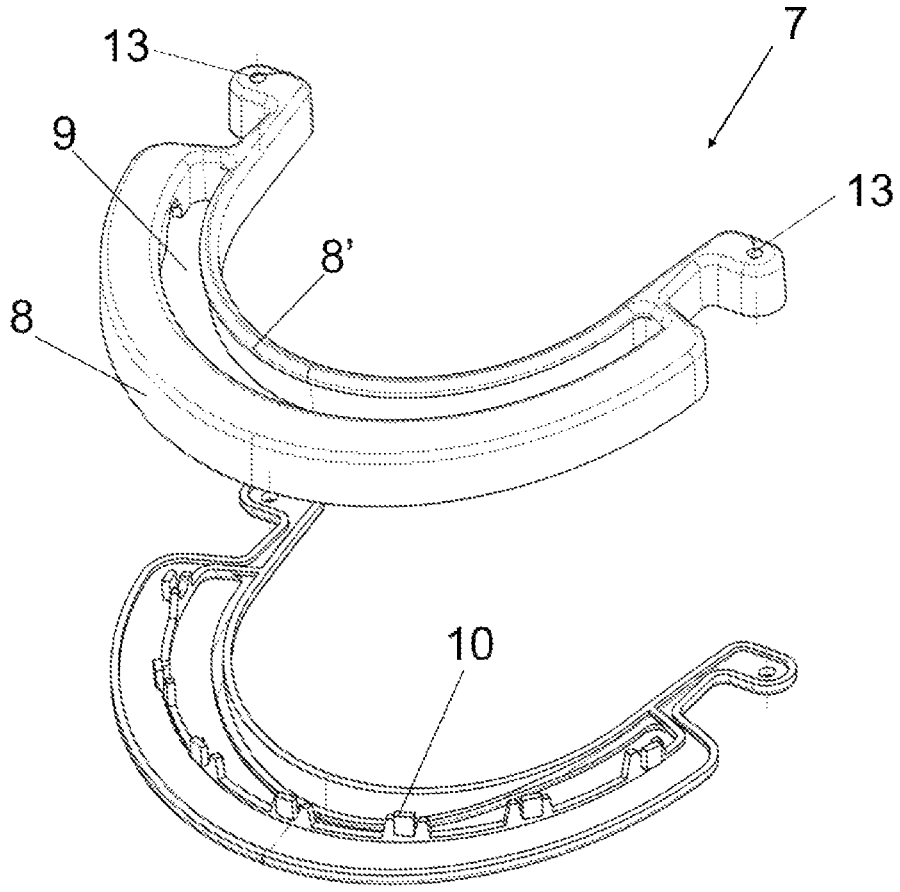
FIG. 5 shows the exploded view of a detail of the disinfection bridge.
Figure 6:
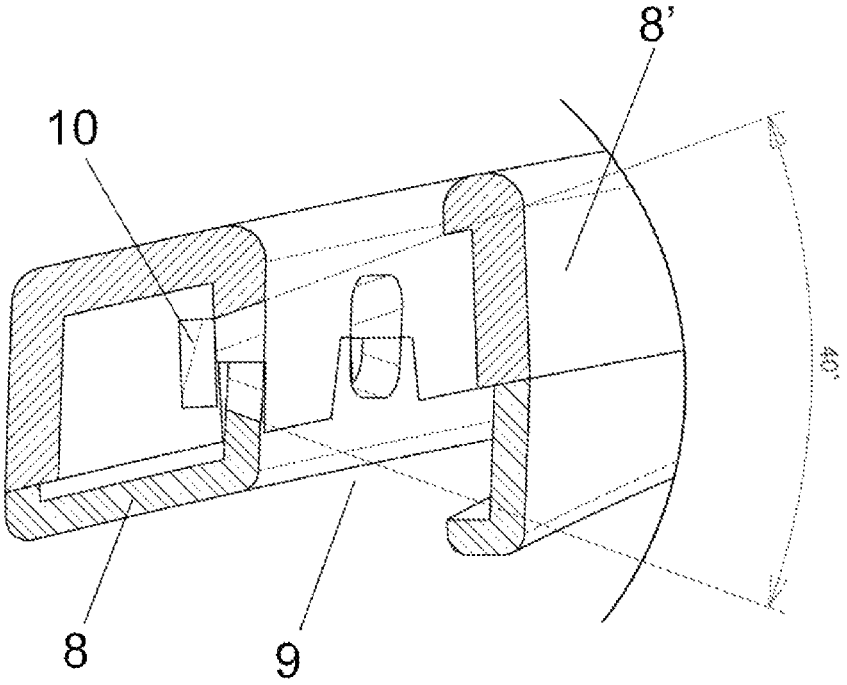
FIG. 6 shows the section view of a detail according to an imaginary vertical plane of section of the disinfection bridge.

As can be seen in FIGS. 5 and 6, this bridge will incorporate inside its arches (8-8') a series of UV LEDs (10) intended for disinfecting both faces of the screen (4) of the facial protection device.

These UV LEDs (10) have a spectrum ranging from 200 nm to the 280 nm known as ultraviolet "UV-C" spectrum.

The bridge (7) and accordingly the arches (8-8') will be obtained in metal made by injection or machining of aluminum-Zamac or thermo-technical plastic.

As can be seen in FIGS. 1, 2, 3 and 4, the bridge (7) can move vertically from a pair of vertical augers (14) provided in slots (11) made on the support arms (6) which determine the support on which the facial protection device rests.

These vertical augers (14) rotate in a synchronized manner by being linked to the ends of the bridge (7) through the corresponding threading, being actuated through a transmission (12) linked to a DC electric motor or control of paso in tensions from 3 to 230 V.

UV-C LED technology modules based on AlGaN and Flip chip, which are techniques for manufacturing devices of this type, will be arranged integrally inside the arches (8-8'). These will be housed in a flexible or rigid aluminum or copper substrate support (MPCB or PCB—printed circuit board), whereas the electronics for controlling this module (in constant current or voltage) as well as the movement of the arcs (8-8') will be arranged in the plate or plates housed in the charging base.

This movement will result in this light spectrum striking the screen (4) and will end up disinfecting the surfaces that are usually in contact with the patient or the professional. This radiation is particularly effective in breaking DNA/RNA bonds of the organisms to be eliminated; the photons will break these bonds in bacteria, fungi, viruses and pathogens in general, causing microbiological inactivation.

The power may vary to reduce the exposure time, since the higher the power, the shorter the exposure time. The facial protection device will have means for adjusting the power and exposure time through an APP in which more or less exposure will be provided depending on the use it has had.

For the pathogen neutralization or disinfection process to be safe for daily use by healthcare personnel, surgeons, orthodontists, veterinarians or any professional, the loading base incorporates an electronic safety system. The UVC radiation must always be below the limits of <0.001 W/m2 established by the occupational safety regulations. This is achieved by placing one or more Doppler tracing devices at a frequency of 60 GHz, this search for bodies will be carried out in 360 degrees constant, i.e., it will always rotate during the disinfection time, this will provide the apparatus with absolute safety in any environment. The sensor device will be completely autonomous and its antenna will also be integrated into the base. The beam opening will be equal to or >45° and the detection distance will also be selectable through the APP.

Returning again to FIG. 1, note that the base will incorporate an interface with light indicators (3) for indicating the state of the device (fully charged/charging/being disinfected, etc.).

The invention claimed is:

1. A loading base for facial protection devices, comprising a main housing having support arms on which a facial protection device with a screen rests, the screen including inner and outer surfaces, a bridge that can move vertically on the support arms, wherein the bridge has a structure in which two parallel arches are defined determining an arched slot, according to a curvature and horizontal section of the screen of the facial protection device, said bridge including a plurality of Ultraviolet Light-Emitting Diodes (UV LEDs) inside the arches for disinfecting both inner and outer surfaces of the screen.

2. The loading base for facial protection devices according to claim 1, wherein the bridge can move vertically from a pair of vertical augers provided in slots made on the support arms.

3. The loading base for facial protection devices according to claim 2, wherein ends of the bridge incorporate perforations through which the bridge is linked to the vertical augers.

4. The loading base for facial protection devices according to claim 1, further including at least one proximity sensor for detecting the presence of a person in the vicinity of the loading base, and controlling the plurality of UV LEDs in response to a detection by the at least one proximity sensor.

5. The loading base for facial protection devices according to claim 1, wherein the loading base is configured to receive instructions to adjust power and exposure time of the plurality of UV LEDs.

6. The loading base for facial protection devices according to claim 1, further including light indicators for indicating at least one of a fully charged state, charging state, and being disinfected state.

7. The loading base for facial protection devices according to claim 1, wherein the bridge is retractable, and in an inoperative state, the bridge is flush with the main housing.

* * * * *